US009519254B2

(12) United States Patent
Anderson et al.

(10) Patent No.: US 9,519,254 B2
(45) Date of Patent: Dec. 13, 2016

(54) SYSTEMS FOR CONFIGURING SETTINGS OF AN ELECTRONIC DEVICE FOR CUSTOMIZATION THEREOF

(71) Applicant: Lexmark International, Inc., Lexington, KY (US)

(72) Inventors: John Douglas Anderson, Lexington, KY (US); Christopher Michael Nelson, Lexington, KY (US); Brian Keith Owens, Lexington, KY (US); Adam Randal Wiedemann, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/573,290

(22) Filed: Dec. 17, 2014

(65) Prior Publication Data

US 2016/0179047 A1 Jun. 23, 2016

(51) Int. Cl.
*G03G 15/00* (2006.01)
*G03G 21/18* (2006.01)

(52) U.S. Cl.
CPC ..... *G03G 15/5062* (2013.01); *G03G 21/1878* (2013.01)

(58) Field of Classification Search
CPC ..... G03G 21/1878; G03G 21/1896; G03G 21/1814; G03G 15/5029; G03G 15/5062; G03G 15/043; G06Q 10/20
USPC ..... 399/74
See application file for complete search history.

(56) References Cited

U.S. PATENT DOCUMENTS

| | | | |
|---|---|---|---|
| 5,659,847 | A | 8/1997 | Tsuda et al. |
| 6,002,898 | A | 12/1999 | Yokomori et al. |
| 6,032,002 | A | 2/2000 | Yokomori et al. |
| 6,256,467 | B1 | 7/2001 | Yokomori et al. |
| 6,285,024 | B1 | 9/2001 | Pinnock |
| 7,480,472 | B2 | 1/2009 | Williams et al. |
| 7,559,635 | B2 | 7/2009 | Conway et al. |
| 8,096,646 | B2 | 1/2012 | Hattori et al. |
| 8,985,442 | B1 | 3/2015 | Zhou et al. |
| 2004/0001723 | A1 | 1/2004 | Ashida et al. |

(Continued)

OTHER PUBLICATIONS

U.S. Appl. No. 14/735,266, filed Jun. 10, 2015.

(Continued)

*Primary Examiner* — Walter L Lindsay, Jr.
*Assistant Examiner* — Jessica L Eley
(74) *Attorney, Agent, or Firm* — Justin M. Tromp

(57) ABSTRACT

A system for customizing settings of an electronic device includes a replaceable component having an optical member for receiving optical energy. The optical member has an optical characteristic for modifying an amount of the optical energy that leaves the optical member relative to an amount of the optical energy received by the optical member. A support is located on an outer casing of the electronic device and the replaceable component is mountable on the support. The system further includes an optical sensor including a detector positioned to receive the amount of the optical energy leaving the optical member when the replaceable component is mounted on the support. A controller determines one or more predetermined settings to be applied to the electronic device based at least upon the amount of the optical energy received by the detector.

22 Claims, 10 Drawing Sheets

(56) References Cited

U.S. PATENT DOCUMENTS

| | | | | |
|---|---|---|---|---|
| 2004/0218934 | A1 | 11/2004 | Silverbrook | |
| 2004/0264984 | A1 | 12/2004 | Yabuki et al. | |
| 2005/0078969 | A1* | 4/2005 | Kikuchi | G03G 21/1892 399/12 |
| 2006/0222383 | A1 | 10/2006 | Mukataka et al. | |
| 2008/0025735 | A1 | 1/2008 | Odani | |
| 2011/0123237 | A1* | 5/2011 | Kudo | G03G 15/161 399/313 |

OTHER PUBLICATIONS

U.S. Appl. No. 14/573,265, filed Dec. 17, 2014.
Final Office Action dated Jun. 20, 2016 for U.S. Appl. No. 14/573,265 (Anderson et al.).

* cited by examiner

SYSTEMS FOR CONFIGURING SETTINGS OF AN ELECTRONIC DEVICE FOR CUSTOMIZATION THEREOF

CROSS REFERENCES TO RELATED APPLICATIONS

None.

BACKGROUND

1. Field of the Disclosure

The present disclosure relates generally to electronic devices and more particularly to systems for customizing settings of an electronic device.

2. Description of the Related Art

Customization of electronic devices, such as image forming devices, is common. For example, an image forming device from a printer manufacturer can have different configurations when provided to different customer entities. That is, the same image forming device can be configured differently to work for a first customer entity than for a second customer entity, and may include different versions of software, features, and/or functionalities. Several factors contribute to the desire for customization such as, for example, customer needs, software programs, geography specific customization, environmental operating conditions, etc.

One of the problems met when customizing an electronic device is how to efficiently configure or adjust configurations of the device prior to shipping the device. In most cases, customization includes adjusting the configuration of existing features or functionalities and/or enabling new features, which typically requires a new configuration file to be manually loaded into firmware. In other instances, the device can have different versions of its firmware such that differences in commands may be required to configure certain functionalities. This practice can be cumbersome and time consuming as it involves hand-coding configurations on the device. Accordingly, there is a need for a more efficient and less cumbersome way of customization.

SUMMARY

A system for customizing settings of an electronic device according to one example embodiment includes a replaceable component having an optical member for receiving optical energy. The optical member has an optical characteristic for modifying an amount of the optical energy that leaves the optical member relative to an amount of the optical energy received by the optical member. A support is located on an outer casing of the electronic device and the replaceable component is mountable on the support. The system further includes an optical sensor including a detector positioned to receive the amount of the optical energy leaving the optical member when the replaceable component is mounted on the support. An optical source, which can be incorporated as part of the optical sensor or implemented as an external light source, is used to emit optical energy towards the optical member. A controller coupled to the optical sensor is operative to determine one or more predetermined settings to be applied to the electronic device based at least upon the amount of the optical energy received by the detector.

A system for configuring one or more settings of an imaging device according to another example embodiment includes a portion of an outer casing of the imaging device mountable on a support of the imaging device. An optical member on the portion of the outer casing has an optical characteristic that is indicative of configuration settings to be used by the imaging device among a plurality of possible configurations settings for the imaging device. An optical sensor is positioned to detect the optical characteristic of the optical member when the portion of the outer casing of the imaging device is mounted on the support. A controller communicatively coupled to the optical sensor is operative to adjust one or more configuration settings of the imaging device based upon the detected optical characteristic of the optical member.

An image forming device according to another example embodiment includes a replaceable component having a transmissive region. An optical sensor is positioned to detect a transmissivity of the transmissive region when the replaceable component is installed on the image forming device. Memory is stored with a plurality of transmissivity values associated with a plurality of possible configuration settings for the image forming device. A controller communicatively couples to the optical sensor and the memory, and is operative to compare the detected transmissivity to the stored plurality of transmissivity values to determine configuration settings corresponding to the detected transmissivity, and to configure the image forming device based upon the determined configuration settings.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
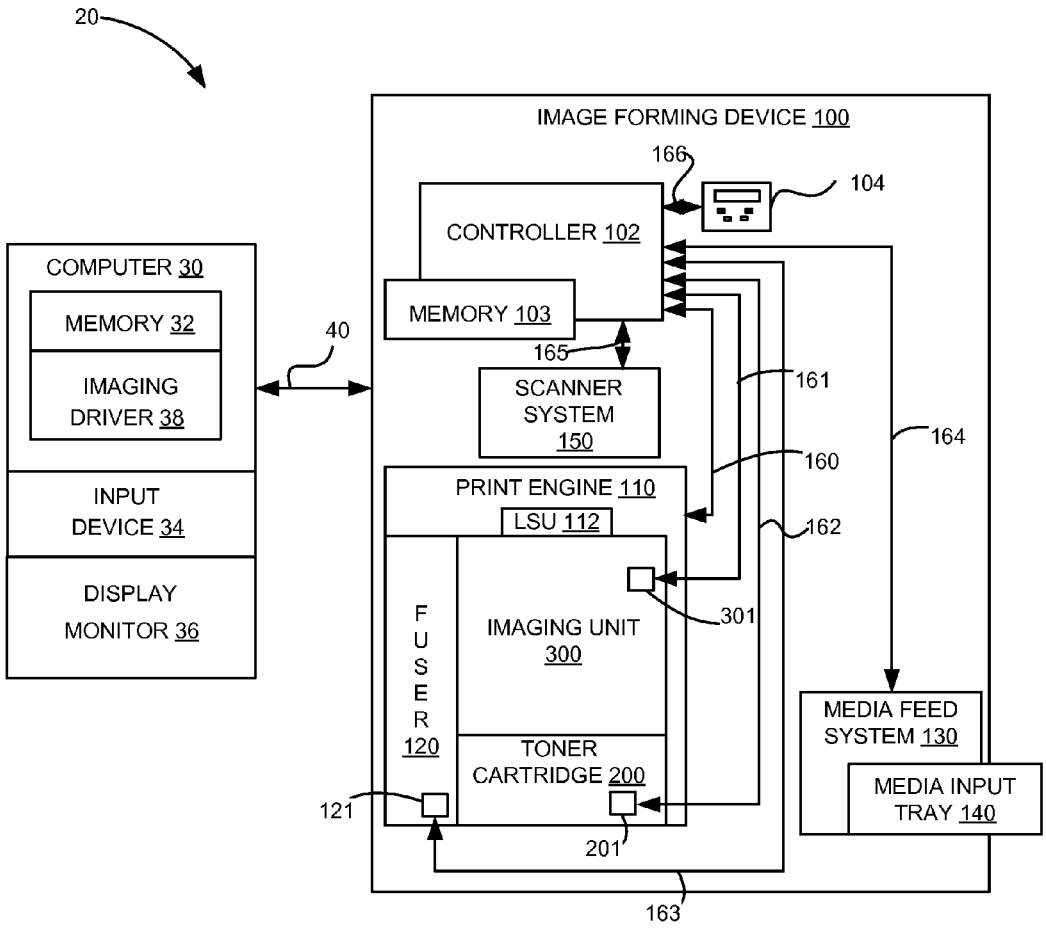
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150, a standalone electrophotographic printer or a standalone scanner.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
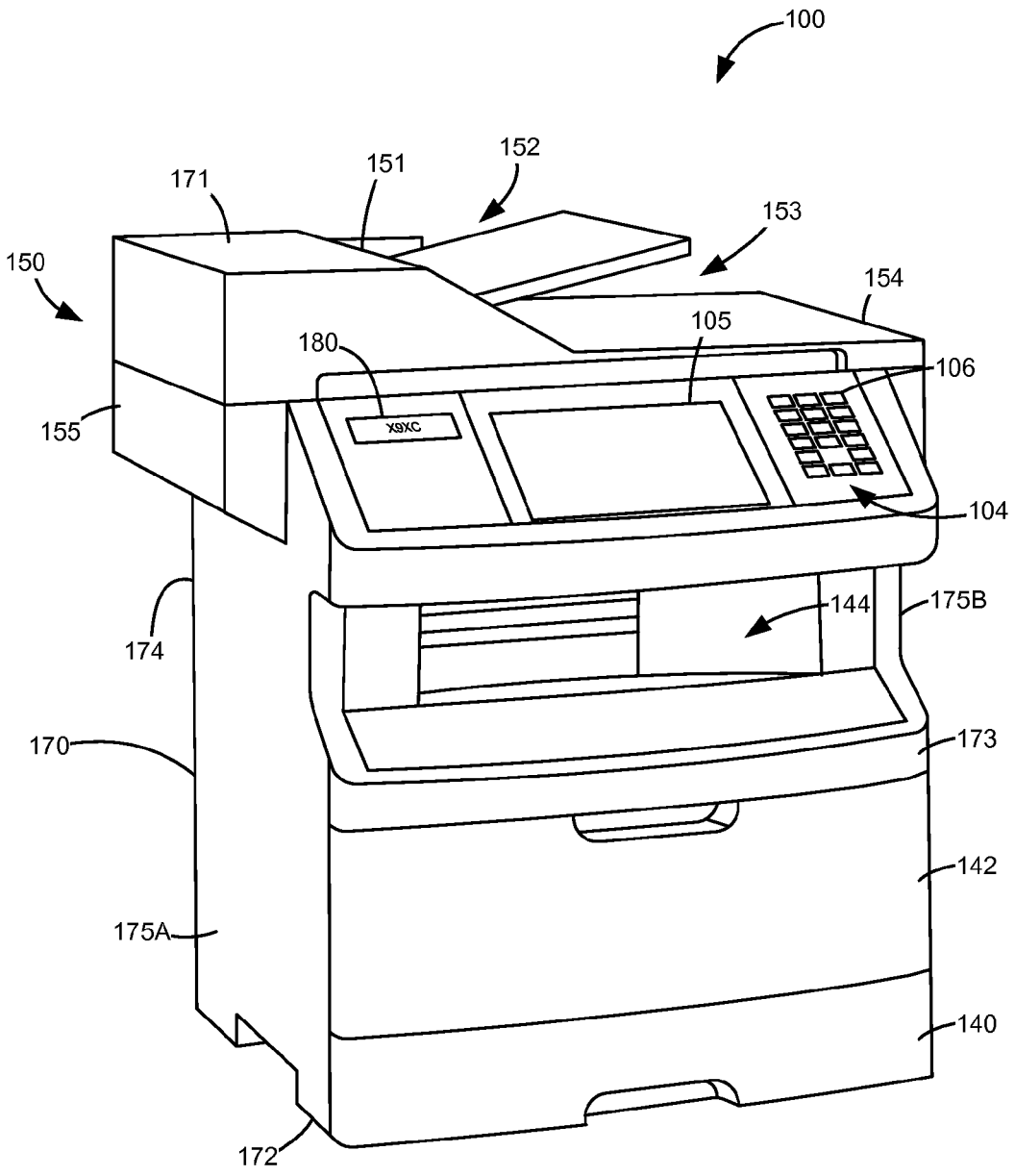
FIG. 2 is a perspective view of an example image forming device according to an example embodiment.

FIG. 2 illustrates a perspective view of an example image forming device 100. Image forming device 100 includes an outer casing or housing 170 having a top 171, bottom 172, front 173, rear 174 and sides 175A, 175B. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A foldout multipurpose media input tray 142 folds out from the front 173 of housing 170 which may be used for feeding a single media sheet or a limited number of media sheets into image forming device 100. A media output area 144 is disposed in the image forming device 100 in which printed media sheets are placed. Scanner 150 is provided on an upper portion of housing 170. Scanner 150 includes an auto-document feeder (ADF) 151 having a media input tray 152 and a media output area 153 provided on a lid 154 mounted on base 155. Scanner 150 may include scan bars in both ADF 151 and base 155 to provide for single and duplex scanning of images.

User interface 104 is shown positioned on housing 170 for receiving user input concerning operations performed or to be performed by image forming device 100, and for providing to the user information concerning the same. User interface 104 may include a display panel 105, which may be a touch screen display in which user input may be provided by the user touching or otherwise making contact with graphic user icons in the display panel 105. Display panel 105 may be sized for providing graphic images that allow for convenient communication of information between image forming device 100 and the user. In addition or in the alternative, a plurality of input keys 106 may be provided to receive user input. Using user interface 104, a user is able to enter commands and generally control the operation of the image forming device 100. For example, the user may enter commands to switch modes (e.g., color mode, monochrome mode), view the number of pages printed, etc.

Image forming device 100 is provided with a nameplate 180. In this example, nameplate 180 comprises a portion of the outer casing or housing 170 of image forming device 100, and can be an ID badge bearing information identifying image forming device 100 and/or indicating available functionalities thereof. When customizing image forming device 100, an operator can replace or change nameplate 180 in order to properly identify image forming device 100 and/or its functionalities.

Figure 3A:
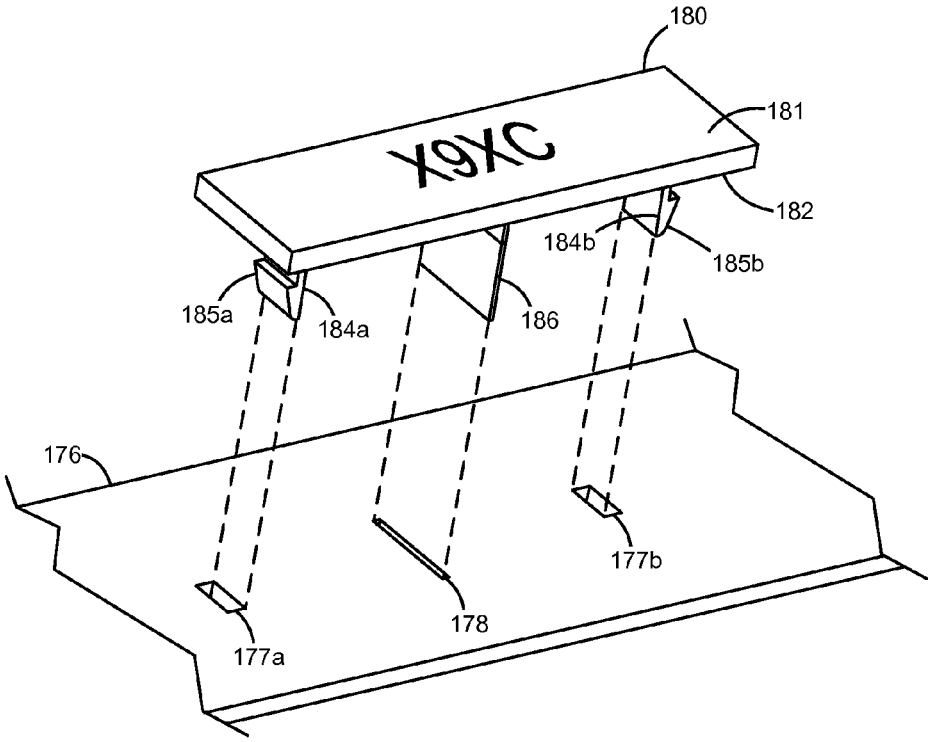
FIG. 3A is a perspective view of a portion of a housing of the image forming device in FIG. 2 including a nameplate and a support on which the nameplate is mountable according to one example embodiment.
Figure 3B:
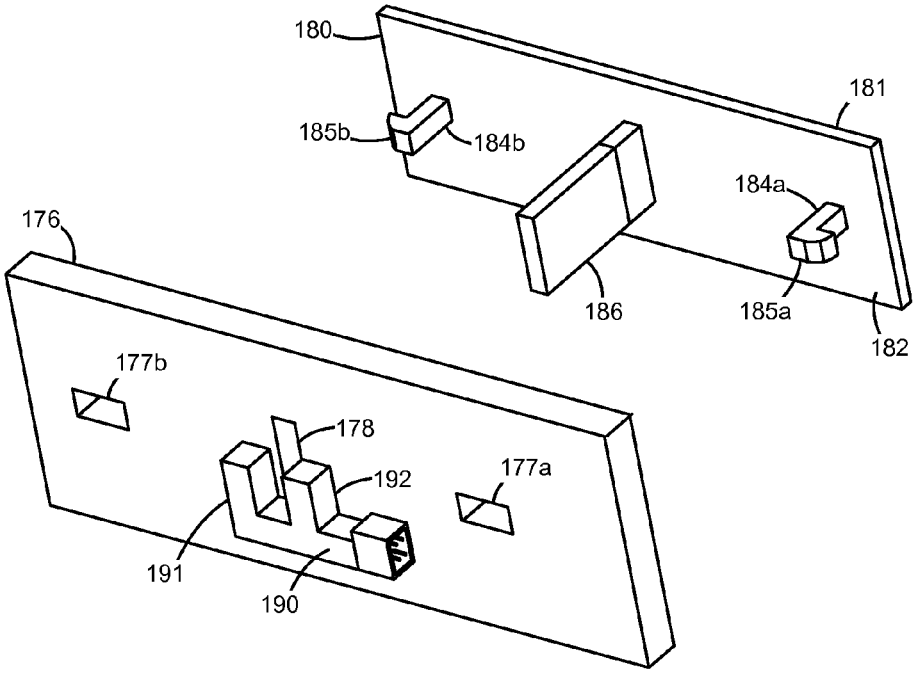
FIG. 3B is a rear perspective view of the nameplate and support shown in FIG. 3A.

FIGS. 3A-3B show a portion of housing 170 including an attachment or support 176 on which nameplate 180 is mountable, and with nameplate 180 removed from support 176. Nameplate 180 includes a top 181 and a bottom 182, and can be made of metal or plastic material, or a combination thereof. Top 181 of nameplate 180 includes one or more lines of characters identifying image forming device 100, while bottom 182 includes engagement pieces 184*a*, 184*b* provided with hook features 185*a*, 185*b*, respectively. Support 176 is provided with support holes 177*a*, 177*b* through which engagement pieces 184*a*, 184*b* are inserted, respectively, to mount nameplate 180 on housing 170 by snap-fit engagement. Although the example illustrations illustrate a snap-fit engagement for mounting nameplate 180 on housing 170, it should be appreciated that nameplate 180 can be mounted on housing 170 using suitable fasteners (e.g., screws, rivets, etc.) or other suitable mounting techniques known in the art.

In accordance with example embodiments of the present disclosure, nameplate 180 may include one or more optically readable features that are used to indicate configuration settings to be used for customizing image forming device 100. Configuration settings, in general, dictate settings to be applied, configured, adjusted, updated, added, or enabled on image forming device 100. An optically readable feature, in general, exhibits optical characteristics or properties that are directly or indirectly correlated with parameters used for configuring image forming device 100. Example optical properties may include, but are not limited to, transmissivity and reflectivity which allow the optically readable feature to transmit and/or reflect optical energy directed to it. Optical energy transmitted or reflected by the optically readable feature can be detected and used by image forming device 100 to determine configuration settings to apply thereon, as will be explained in greater detail below. In general, the optically readable feature is readable by an optical sensor of image forming device when nameplate 180 is mounted on housing 170.

In the example embodiment illustrated in FIGS. 3A-3B, an optically readable transmissive member 186 projects from bottom 182 of nameplate 180. A slot 178 is formed on support 176 between support holes 177*a*, 177*b*, through which transmissive member 186 is inserted upon mounting nameplate 180 on housing 170. Adjacent to slot 178 is an optical sensor 190 positioned to detect transmissive member 186 when transmissive member 186 is mounted on support 176.

Transmissive member 186 generally includes a transmissive region having a characteristic transmissivity for changing an amount of optical energy received by a receiver of optical sensor 190 relative to an amount of optical energy emitted by a transmitter thereof. In one example, the transmissive region may be constructed of a material having a substantially transmissive base material, such as polycarbonate, and additives that modify opacity and transmissivity thereof. In another example, transmissivity may be modified by varying the thickness of the transmissive member 186. In still another example, the transmissive member 186 may have a textured surface that can cause scattering and/or reflection of incident optical energy emitted by the optical sensor transmitter and, thus, less energy reaching the receiver. As will be appreciated, transmissivity of the transmissive region may be modified to block optical energy using different combinations of scattering, diffusion, reflection, absorption, diffraction or other mechanisms as are known in the field of optics and electromagnetics.

Figure 4:
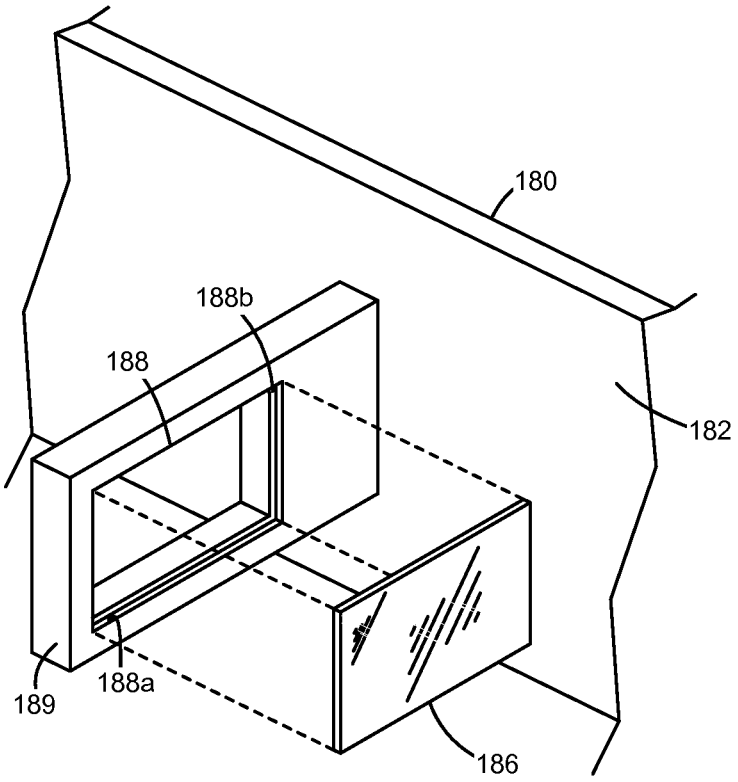
FIG. 4 illustrates a transmissive member that is insertable into a frame of the nameplate according to one example embodiment.

In one example embodiment, transmissive member 186 may be integrally formed as a unitary piece with nameplate 180. In another example embodiment, transmissive member 186 may be implemented as an insert to a frame member on nameplate 180, and/or detachably attached thereto. For example, with reference to FIG. 4, transmissive member 186 is insertable into an aperture 188 formed on a frame 189 projecting from bottom 182 of nameplate 180. In the illustrated embodiment, aperture 188 includes interior walls 188*a* that form a perimeter having a size that allows transmissive member 186 to fit closely into aperture 188. Ledges 188*b* are formed near the bottom of interior walls 188*a* such that when transmissive member 186 is inserted into aperture 188, transmissive member 186 rests in contact and on top of ledges 188*b*. Additionally, transmissive member 186 may be adhesively attached to interior walls 188*a* and/or ledges 188*b* to hold transmissive member 186 in place on frame 189.

Referring back to FIG. 3B, optical sensor 190 includes a transmitter 191 and a receiver 192. Transmitter 191 emits electromagnetic or optical energy, which may consist of visible light or near-visible energy (e.g., infrared or ultraviolet), that is detectable by receiver 192. Transmitter 191 may be embodied as an LED, a laser diode, or any other suitable device for generating optical energy. Receiver 192 may be implemented as a photodetector, such as a photodiode, PIN diode, phototransistor, or other devices capable of converting optical energy into electrical signal. Transmitter 191 emits optical energy along an optical path and receiver 192 receives the optical energy from transmitter 191. In the example illustrated, optical sensor 190 is positioned within housing 170 or on the backside of support 176. However, it is contemplated that optical sensor may be positioned elsewhere on or within image forming device 100 so long as it can read transmissive member 186 upon mounting thereof on housing 170.

Figure 5A:
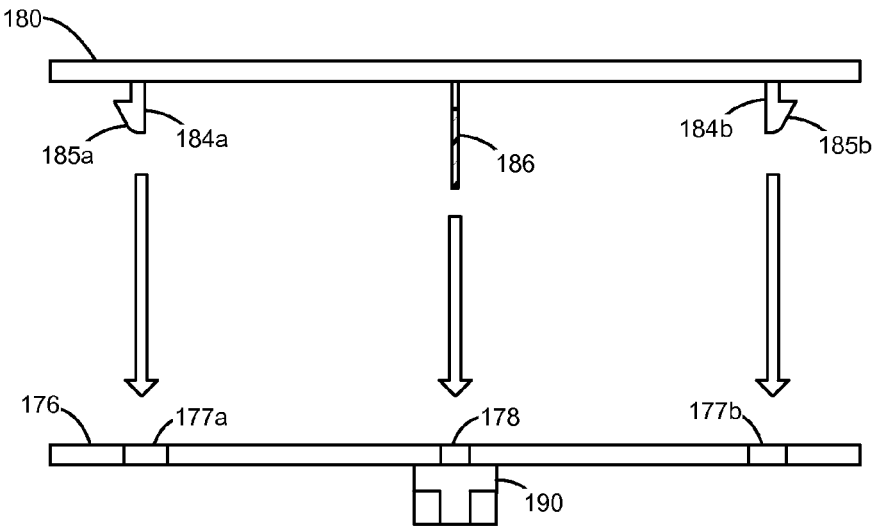
FIG. 5A-5B are sequential views illustrating attachment of the nameplate to the support according to one example embodiment.
Figure 5B:
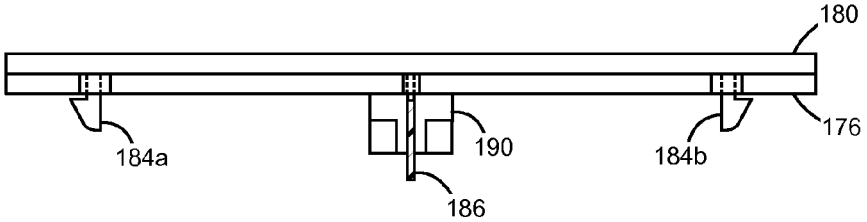

FIGS. 5A-5B are sequential views illustrating attachment of nameplate 180 on support 176. Engagement pieces 184*a*, 184*b* are aligned with support holes 177*a*, 177*b* and the user pushes nameplate 180 towards support 176. Hook features 185*a*, 185*b* are deflected as they are inserted into support holes 177*a*, 177*b*, and return to their original shape as they pass the edges of corresponding support holes 177*a*, 177*b* to thereby restrict movement of nameplate 180 on housing 170. Transmissive member 186 also inserts through slot 178 and is positioned between transmitter 191 and receiver 192 of optical sensor 190.

Figure 6:
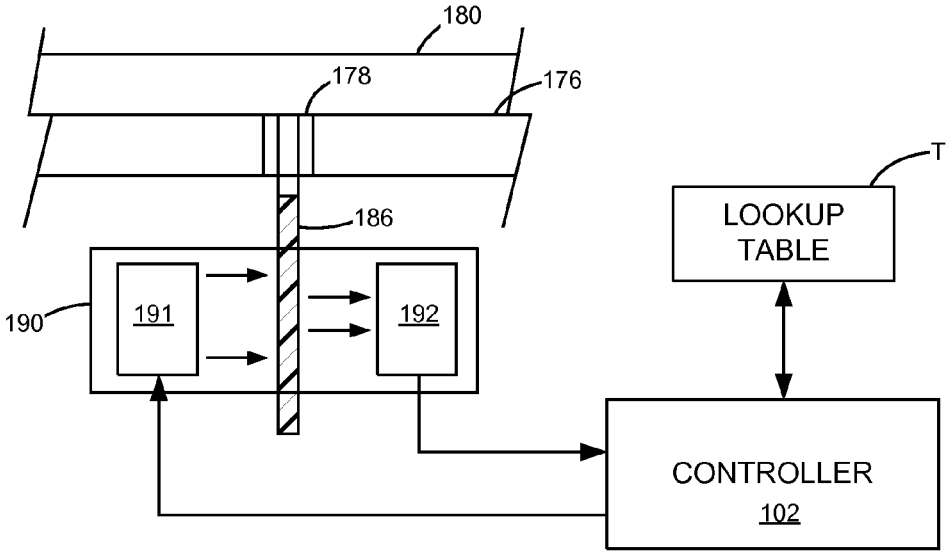
FIG. 6 is a block diagram illustrating communication between a controller and an optical sensor of the image forming device according to one example embodiment.

In FIG. 6, controller 102 is shown coupled to optical sensor 190 and is configured to communicate therewith to control activation of transmitter 191 and receive signals from receiver 192. Additional circuitries on board may also be used to convert signals into forms suitable for use by controller 102 and/or optical sensor 190. In operation, controller 102 generates a signal for driving transmitter 191 to emit optical energy and receiver 192 generates an output signal based on the amount of optical energy it receives. As transmissive member 186 is positioned along the optical transmission path between transmitter 191 and receiver 192, it operates as an interrupter of sorts which blocks at least some fraction of the optical energy emitted by transmitter 191 that is incident on transmissive member 186 and allows at least some fraction of the optical energy incident on transmissive member 186 to pass therethrough and reach receiver 192. Signals that are output by receiver 192 based on the optical energy it receives are received and analyzed by controller 102, or other associated processing circuitries, to determine transmissivity of transmissive member 186. Raw data by optical sensor 190 may be converted to discrete digital values. For example, data obtained from optical sensor 190 may be encoded into one of a plurality of discrete values corresponding to a transmissivity value.

In an example embodiment, code may be written in firmware of image forming device 100 to instruct controller 102 to check for an existence of a set of predetermined configuration settings to apply to image forming device 100 based on the output of optical sensor 190. For example, the detected transmissivity may direct controller 102 to access a lookup table T to look for an association or mapping where appropriate settings may be located. In an example embodiment, lookup table T includes transmissivity values that correlate to different sets of possible configuration settings for image forming device 100. Lookup table T may be stored in memory 103 of image forming device 100. Alternatively, lookup table T may be stored remotely over the Internet or in the cloud on a server, a USB drive, an external hard drive, or other storage location external to image forming device 100. An example lookup table showing transmissivity values (in terms of percentage) and corresponding settings, is illustrated in Table 1.

TABLE 1

Transmissivity and Device Settings

| Transmissivity Range | Device Setting |
|---|---|
| 5%-20% | Setting A |
| 30%-45% | Setting B |
| 55%-70% | Setting C |
| 80%-95% | Setting D |

As shown, Table 1 includes a plurality of table records. Each table record includes a predetermined transmissivity range and a corresponding predetermined setting. The predetermined transmissivity range corresponds to a range of transmissivity values within which transmissivity of a transmissive member 186 being read may fall, and the corresponding predetermined setting indicates one or more settings, operating parameters, features, and/or functions to be configured, adjusted, or customized on image forming device. The predetermined settings, in this example, include four predetermined device settings A-D. As an example, if a transmissivity value of about 40% for a transmissive member 186 is detected, then image forming device 100 may be customized using predetermined settings included in Setting B. As a result, the lookup table in Table 1 provides a reference for determining settings for image forming device 100 using transmissivity values. The transmissivity ranges allows for tolerance variations with respect to transmissive members correlated to the same predetermined set of settings, and can be pre-calibrated during manufacture. Multiple samples of a reference transmissive member (i.e., transmissive members of the same kind having substantially the same transmissivity to be corresponded to a common set of settings) are measured for transmissivity to determine a transmissivity range for such kind of transmissive member. In this way, a transmissivity range and a corresponding characteristic is prepared and stored for each kind of transmissive member 187. It should be appreciated that testing of transmissive members to obtain different transmissivity ranges is performed using the same type or structure of optical sensor used by image forming device 100.

The number of table records and the predetermined transmissivity values and corresponding predetermined settings are not limited to the examples illustrated above. For example, the lookup table may include more or fewer table records, and other example embodiments may include a plurality of lookup tables including other parameters or values derived from the output of optical sensor 190, and corresponding predetermined settings provided and stored in memory 103. Controller 102 may utilize a plurality of table address pointers for specifying which lookup table to access.

Figure 7:
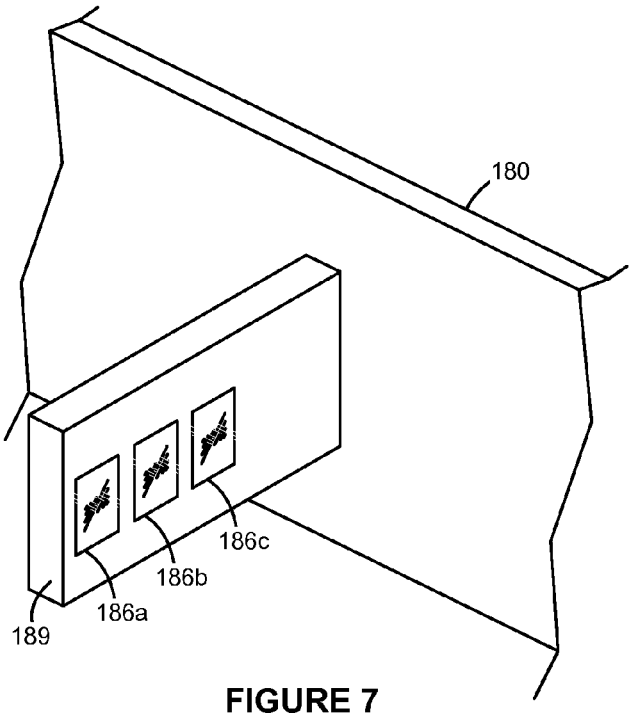
FIG. 7 is a perspective view of the nameplate including multiple transmissive members according to one example embodiment.
Figure 8A:
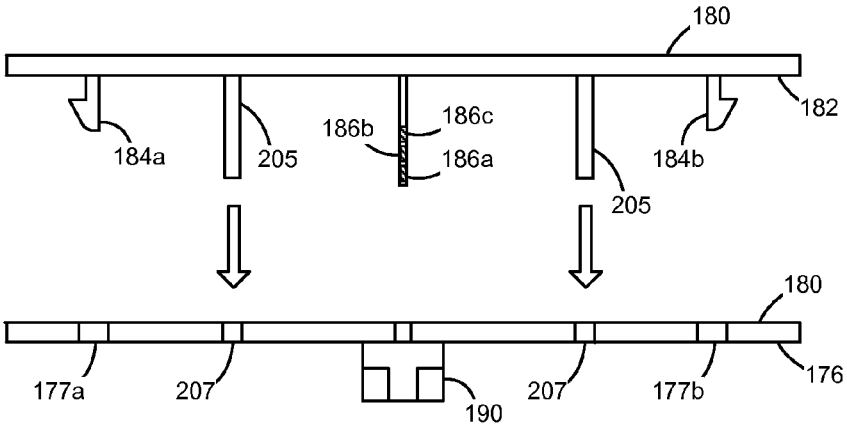
FIGS. 8A-8B are sequential views illustrating attachment of the nameplate with multiple transmissive members in FIG. 7 to the support according to one example embodiment.
Figure 8B:
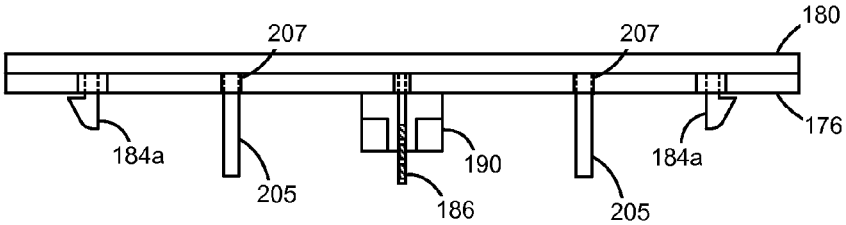

In another example embodiment, frame 189 may include multiple transmissive members 186. For example, with reference to FIGS. 7, 8A and 8B, frame 189 includes a plurality of transmissive members 186*a*, 186*b*, and 186*c*. The placement of transmissive members 186*a*, 186*b*, 186*c* can be provided such that each transmissive member passes through optical sensor 190 upon attaching nameplate 180 on support 176. In this example, optical sensor 190 is disposed in a position that would allow each transmissive member 186 to pass through the optical path of optical sensor 190 before nameplate 180 reaches its final position on support 176. Each transmissive member 186 is appropriately sized to allow detection by optical sensor 190. In one example embodiment, to facilitate a substantially linear movement of frame 189 between the transmitter and receiver of optical sensor 190 during installation of nameplate 180 on support 176, bottom 182 of nameplate 180 may be provided with a plurality of guide arms 205 that insert through corresponding guide holes 207 formed on support 176. Sequential views of attaching nameplate 180 on support 176 are illustrated in FIGS. 8A-8B, with guide arms 205 aligning with and inserting through corresponding guide holes 207 on support 176. In this example, each guide arm 205 may be shaped and sized to fit closely into its corresponding guide hole 207 so as to substantially limit movement of nameplate 180, and thus frame 189, along a direction perpendicular to the optical path of optical sensor 190 during installation of nameplate 180 on support 176. In another example embodiment where frame 189 includes multiple transmissive members 186, multiple optical sensors 190 read the transmissive members 186, e.g., one optical sensor 190 per transmissive member 186.

According to an example embodiment, different possible configuration settings may be accomplished by providing a combination of multiple transmissive members having varying transmissivities. For example, transmissivity of transmissive members 186*a*, 186*b*, 186*c* may be varied to create a binary system for dividing the available electrical range into multiple sections. As an example, a first type of transmissive member having a first transmissivity may indicate a binary 0 value while a second type of transmissive member having a second transmissivity may indicate a binary 1 value. In the example embodiment where there are three (3) transmissive members in frame 189, 8 bits of information, corresponding to $2^3$ or eight (8) possible combinations, are available for indicating configuration settings to be applied. With two (2) transmissive members 186, a 2-bit digital signature can be created having $2^2$ or 4 possible combinations for indicating configuration settings to be applied. Generally, with N number of transmissive members 186, $2^N$ possible combinations can be used. This example embodiment can provide relatively fewer unique components to manage which can be advantageous for manufacturing. In an alternative example embodiment, each transmissive member on frame 189 indicates a different customization or configuration setting to be applied.

In another example embodiment, multiple transmissive members may be positioned in a stacked arrangement along a single aperture on frame 189. For example, with reference to FIGS. 9A-9B, two transmissive members 186*a*, 186*b* are positioned on opposed sides of frame 189 and/or are sandwiched together to form a stack of transmissive members along aperture 188, resulting in a net transmissivity through aperture 188 equal to a product of the individual transmissivities of transmissive members 186*a*, 186*b*. By using multiple transmissive members in a stacked arrangement, various combinations of possible net transmissivity values may be obtained for indicating configuration settings to be applied to image forming device 100. For example, where there are two types of transmissive members having two different transmissivities and two transmissive members 186*a*, 186*b* are stacked together, four net transmissivity values are available for indicating the configuration settings to be applied. In general, where N types of transmissive members having N different transmissivities are arranged in a stack of X transmissive members, $X^N$ possible net transmissivity values are available for use.

In one example embodiment, transmissivity of a transmissive member 186 may be measured as a relative measurement obtained by measuring an amount of optical energy received by receiver 192 with the absence of the transmissive member 186 and the amount of optical energy received by receiver 192 when the transmissive member 186 is between transmitter 191 and receiver 192. For example, a baseline measurement reading may be obtained by emitting optical energy along the optical path from transmitter 191 to receiver 192 while no nameplate is mounted on support 176. When a nameplate 180 is mounted on support 176 and transmissive member 186 moves into the optical path of optical sensor 190, optical energy collected by receiver 192 may correspond to an actual measurement reading. A ratio between the actual measurement and the baseline measurement readings may be used to determine transmissivity of transmissive member 186. For example, transmissivity may be determined using a mathematical relationship: $T=Y/X$; where T corresponds to transmissivity, Y corresponds to the actual measurement reading and X corresponds to the baseline measurement reading. As an example, consider a baseline measurement reading having some trivial output of about 10 volts and an actual measurement reading of about 8 volts. In terms of percentage, transmissivity of the transmissive member is about 80%. Alternatively, actual measurement reading may be directly correlated to a transmissivity value and a corresponding predetermined set of configuration settings, in other example embodiments. It is also contemplated that other means for representing transmissivity may also be used.

Optical sensor 190 may be calibrated to compensate for design tolerances, sensitivity variations, and the like. For example, optical energy may be directed onto receiver 192 without any interruption or obstruction, such as when nameplate is not mounted on support 176, to produce an output voltage. If the output voltage is below a predetermined threshold, controller 102 may adjust the signal for driving transmitter 191 such that the output voltage corresponds to a desired voltage output. As will be appreciated, other methods for calibrating optical sensor 190 may be used as are known in the art.

In an example embodiment, an independent power source 107 (FIG. 6) may be provided to allow calibration, as well as measurement readings on transmissive members 186, to be performed even when image forming device 100 is powered off or disconnected from the AC mains. For example, independent power source 107 may include a rechargeable battery, wireless charging devices which convert electromagnetic energy of radio signals into electrical power, or other power generating devices to provide power to controller 102. In one example, controller 102 may receive power from power source 107, and transfer power to optical sensor 190 through wires electrically coupling it to controller 102. In another example, optical sensor 190 can receive power directly from power source 107. Use of additional circuitries on board may also be used to convert electrical power into forms suitable for use by controller 102 and/or optical sensor 190. In another example embodiment, optical sensor 190 receives its power from image forming device 100 such that optical sensor 190 is powered on only when image forming device 100 is powered on. In this embodiment, where frame 189 includes multiple transmissive members 186, multiple optical sensors 190 read the transmissive members 186.

Figure 10A:
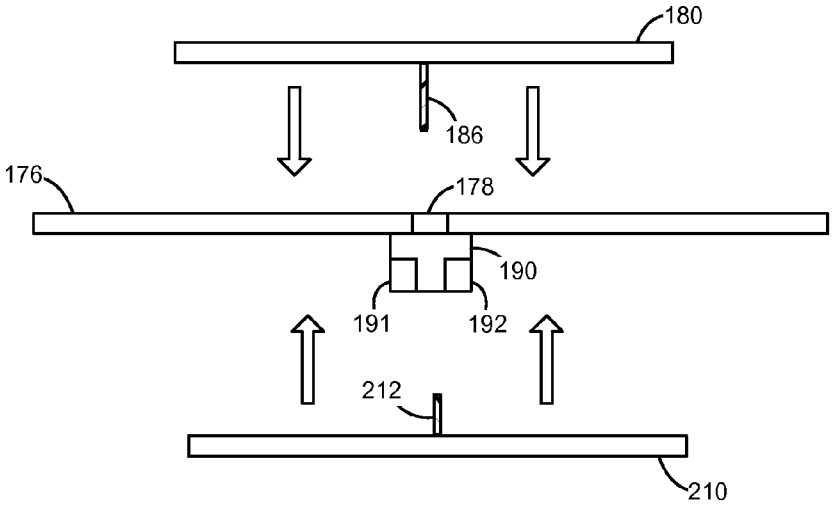
FIGS. 10A-10B illustrate a replaceable component that is mounted opposite the side of the support where the nameplate is attached according to one example embodiment.
Figure 10B:
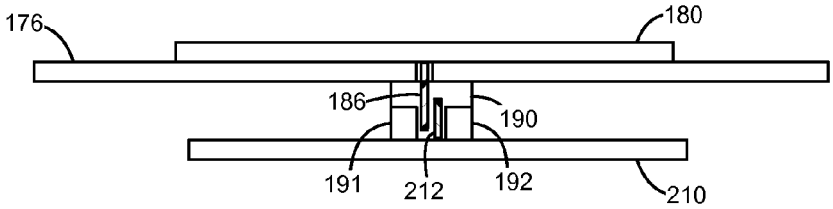

According to another example embodiment, a second replaceable component may be provided with a second transmissive member that is readable by optical sensor 190. For example, with reference to FIGS. 10A-10B, image forming device 100 may be provided with a second replaceable member 210 that can be mounted within image forming device 100 opposite the side of support 176 where nameplate 180 is attached. In an example embodiment, second replaceable member 210 may comprise a printed circuit board (PCB), such as a near-field communication (NFC) or Bluetooth card, or any other component that can be attached to or separated from the assembly. When customizing image forming device 100, an operator may replace or change second replaceable member 210 to customize other configuration settings of image forming device 100.

Figure 9B:
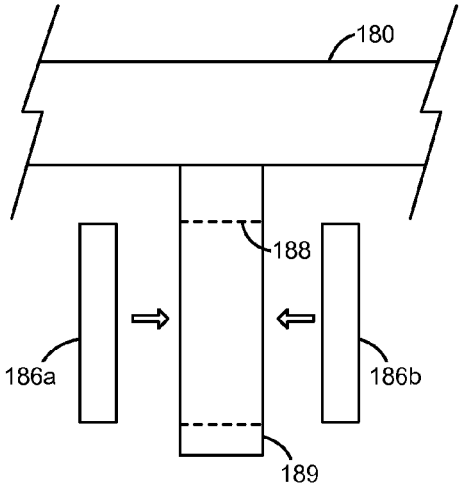
FIGS. 9A-9B illustrate the nameplate having multiple transmissive members populated in a single aperture according to one example embodiment.
Figure 9A:
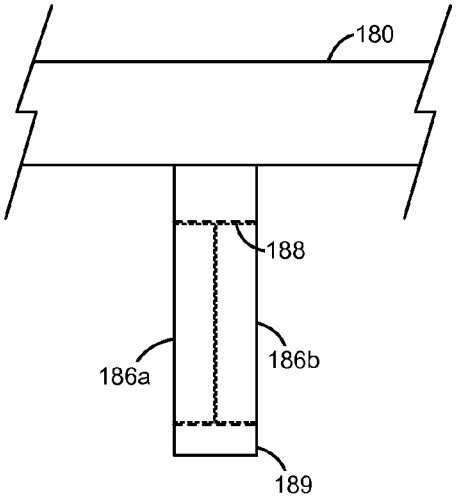

Second replaceable member 210 includes a second transmissive member 212 protruding from a surface thereof. In one example embodiment, optical sensor 190 may be operative to simultaneously read both transmissive members 186, 212 of nameplate 180 and second replaceable member 210, respectively, when both are installed as shown in FIG. 9B. Separation distance between transmitter 191 and receiver 192 of optical sensor 190 is sized to accommodate both transmissive members 186, 212. In one example embodiment, a net amount of optical energy received by receiver 192 may be used to determine a net transmissivity, which corresponds to a product of the transmissivities of transmissive members 186, 212. The net transmissivity may then be used to determine configuration settings to apply to image forming device 100.

In another example embodiment, individual transmissivity of transmissive members 186, 212 may each be measured and used to determine configuration settings to apply to image forming device 100. For example, transmissivity of second transmissive member 212 may first be measured in the absence of transmissive member 186 of nameplate 180. While second transmissive member 212 is positioned along the optical path of optical sensor 190, nameplate 180 may be installed to also position its transmissive member 186 along the optical path. Thereafter, the change in the amount of optical energy received by receiver 192 may then be used to determine transmissivity of transmissive member 186. As an example, net transmissivity may be determined based on the new amount of optical energy received by receiver 192. Because the net transmissivity corresponds to the product of both transmissivities of transmissive members 186, 212, transmissivity of transmissive member 186 may be determined by dividing the net transmissivity by the initially determined transmissivity of second transmissive member 212. In an alternative example embodiment, a single optical source may be used with multiple receivers to read multiple transmissive members independently. Each transmissivity value determined may be individually used to determine configuration settings to apply to image forming device 100. Alternatively, the particular combination of the transmissivity values may be used to determine customization settings.

In another example embodiment, transmissivity of second transmissive member 212 of second replaceable member 210 may be used to allow hardware to lock out certain types of modes or operations of image forming device 100. In particular, transmissivity of second transmissive member 212 may be used to lock image forming device 100 into a specific mode which cannot be modified by changing only software. In order to unlock such mode and enable a different mode, second replaceable member 210 would need to be replaced with a component having a transmissive member that can indicate a new mode of operation. Otherwise, the mode may not be overwritten by software installations or updates and may stay resident through firmware upgrade or even if the controller board is replaced. On the other hand, transmissivity of transmissive member 186 associated with nameplate 186 may be used to accommodate other customizable settings of image forming device 100. In this example embodiment, image forming device 100 may be hardware constrained to use specific modes of operations using second transmissive member 212, and at the same time readily customizable using transmissive member 186 of nameplate 180.

Figure 11:
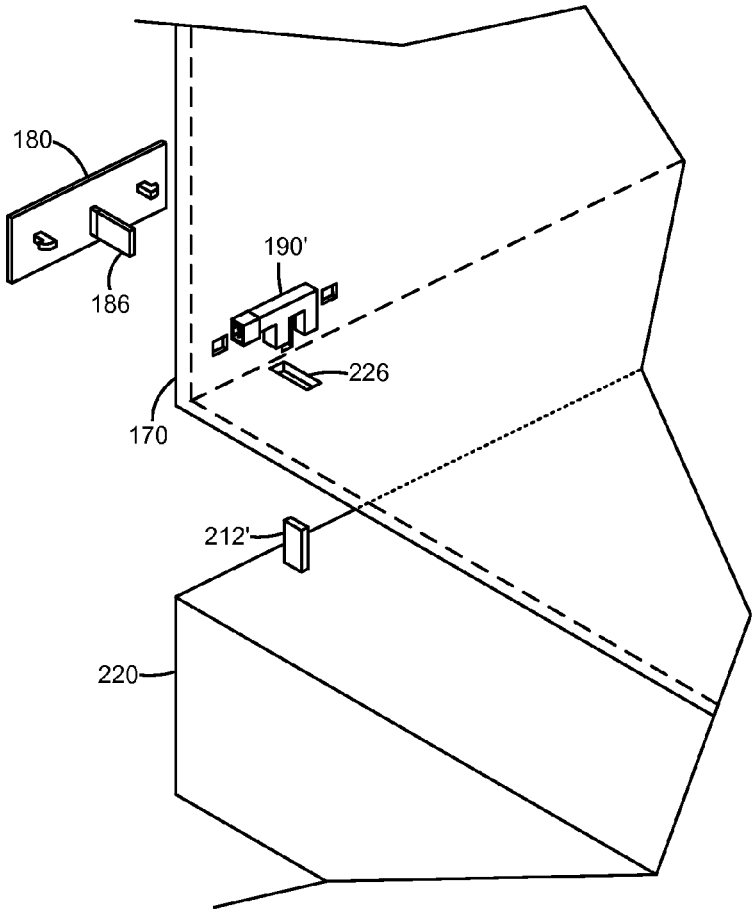
FIG. 11 is a perspective view illustrating an option unit with a transmissive member and an optical sensor positioned near a bottom of the housing of the image forming device for reading the option unit transmissive member according to one example embodiment.
Figure 12:
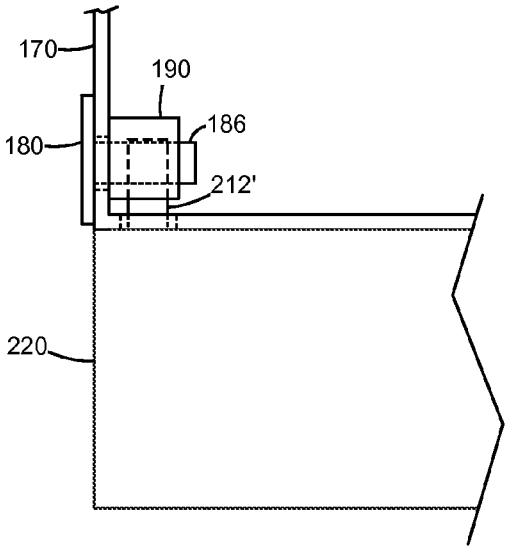
FIG. 12 is a side view illustrating the option unit in FIG. 11 attached to the bottom of the housing of the image forming device.

FIG. 11 illustrates another example embodiment where two transmissive members are used in conjunction with an optical sensor. As shown, a second transmissive member 212' is attached to or forms part of an option unit 220 that is attachable to a bottom of housing 170 of image forming device 100. Meanwhile, an optical sensor 190' is positioned at a lower side and near the bottom of housing 170 and arranged to read transmissive member 186 of nameplate 180 when mounted to housing 170. Second transmissive member 212' generally protrudes from a top of option unit 220 such that it insertable through a slot 226 formed on the bottom of housing 170 and positionable between the transmitter and receiver of optical sensor 190' when option unit 220 is attached to image forming device 100. In FIG. 12, nameplate 180 is attached to housing 170 and option unit 220 is attached to the bottom of housing 170. In this example embodiment, optical sensor 190' is capable of reading both transmissive members 186, 212' in the same manner as discussed above with respect to FIGS. 9A-9B. In one example embodiment, second transmissive member 212' may be used to confirm attachment of option unit 220 to image forming device 100 while transmissive member 186 of nameplate 180 may be used to determine customization settings to apply to image forming device 100. Alternatively, use of second transmissive member 212' on option unit 210 may be implemented independent of nameplate 180. That is, optical sensor 190' may read second transmissive member 212' in the absence of nameplate 180, and the detected transmissivity of second transmissive member 212' may be used to confirm attachment of option unit 210 and/or to determine customization or configuration settings to be applied. These example embodiments can provide the capability to track option units that are attachable to image forming device 100 but which cannot communicate therewith, such as a caster base or other non-electronic option units.

Figure 13:
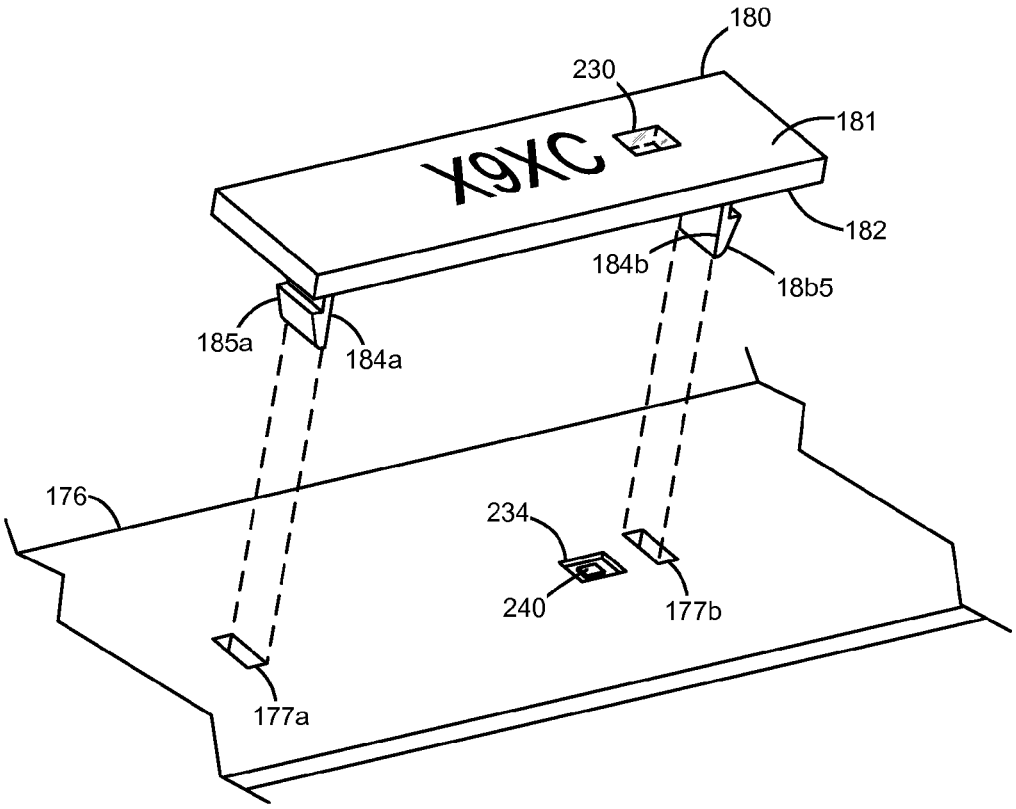
FIG. 13 is a perspective view of the nameplate including a transmissive member disposed on a main body of the nameplate and an optical detector on the support for reading the transmissive member according to one example embodiment.
Figure 14:
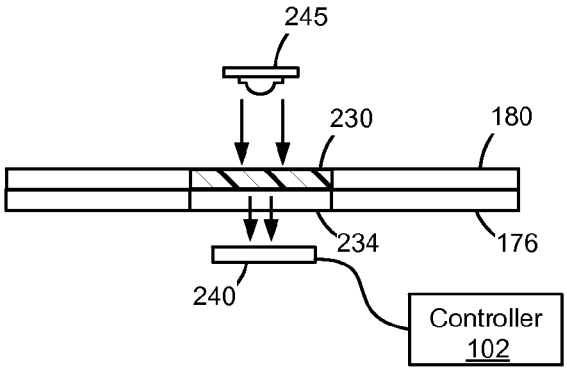
FIG. 14 is a side view illustrating the nameplate in FIG. 13 attached to the support and an external light source illuminating the transmissive member according to one example embodiment.

FIG. 13 shows another optically readable feature and sensor arrangement, according to another example embodiment. As shown, a transmissive member 230 is provided as part of the main body of nameplate 180. Transmissive member 230 may be formed integral to nameplate 180 or provided as an insert thereto. An aperture 234 is formed on support 176 to provide an opening through which an optical detector 240 mounted within housing 170 adjacent aperture 234 may read transmissive member 230. In FIG. 14, nameplate 180 is attached to support 176 and transmissive member 230 coincides with the location of aperture 234 and optical detector 240. In one example embodiment, an external light source 245 may be used to emit light onto transmissive member 230 to allow measurement of its transmissivity. External light source 245 may be any light source capable of emitting optical energy in the infrared, visible, or ultraviolet regions of the electromagnetic spectrum. Depending on the transmissivity of transmissive member 230, some fraction of the optical energy emitted by external light source 245 passes through transmissive member 230 and is received by optical detector 240. Output signal corresponding to the amount of optical energy received by optical detector 240 may then be used by controller 102 to determine the transmissivity of transmissive member 230 and thereafter, determine a corresponding configuration setting to apply to image forming device 100. In one example application, transmissive member 230 may be disposed near a label or barcode provided on nameplate 180 such that when the barcode is scanned during configuration, transmissive member 230 can also be illuminated and read by optical detector 240.

In one example embodiment, transmissivity of transmissive member 230 may be measured as a relative measurement obtained by measuring an amount of optical energy received by optical detector 240 from external light source 245 with the absence of transmissive member 230 (i.e., when nameplate 180 is not mounted on support 176) and the amount of optical energy received by optical detector 240 when transmissive member 230 is covering aperture 234 (i.e., when nameplate 180 is mounted on support 176). For example, a baseline measurement reading may be obtained by directly emitting optical energy onto optical detector 240 using external light source 245 while nameplate 180 is not mounted on support 176. When nameplate 180 is mounted on support 176, external light source 245 may be used to illuminate transmissive member 230. Optical energy collected by optical detector 240 may correspond to an actual measurement reading and, together with the baseline measurement, may be used by controller 102 to calculate the transmissivity of transmissive member 230.

In other example embodiments, transmissive members of differing sizes or shapes can be used, and other patterns, positioning or spacing between transmissive members, and other arrangements between transmissive member(s) and sensor(s), may be implemented. Additionally, one or more passive or active wiper features (not shown) may be disposed adjacent the slot(s) and upstream of the optical sensor, relative to the direction of insertion of the transmissive member(s) into corresponding slot(s), for cleaning the optical surfaces of the transmissive member(s) prior to being read by the optical sensor. A plurality of lookup tables including different transmissivity values or other parameters derived therefrom and corresponding configuration settings for customizing image forming device 100, may be provided and stored in memory 103. Controller 102 may utilize a plurality of table address pointers for specifying which lookup table to access.

Figure 15:
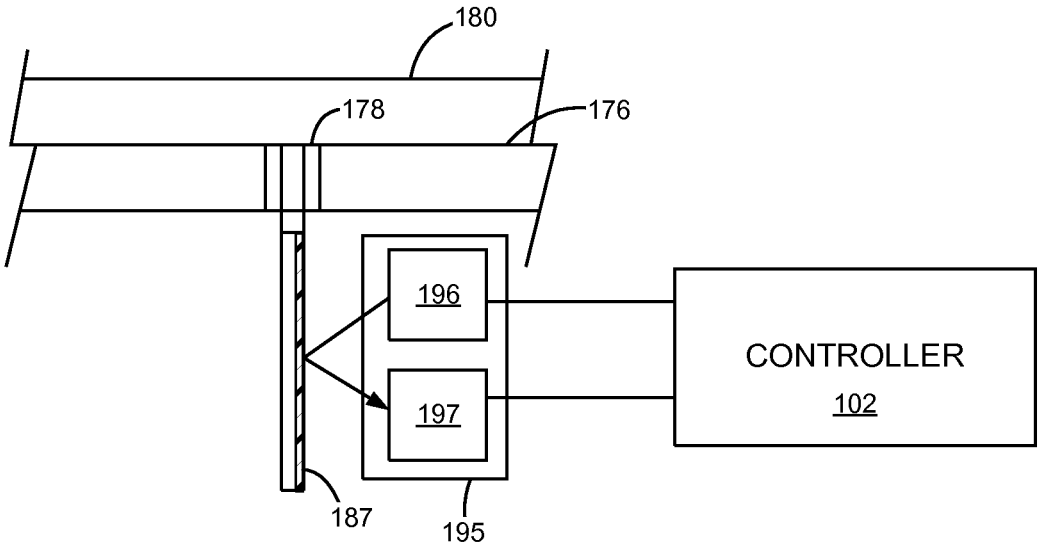
FIG. 15 illustrates a reflective member projecting from the nameplate according to one example embodiment.

The above example embodiments have been described with respect to utilizing transmissivity of optically readable features to indicate settings to apply to image forming device 100. According to another example embodiment, reflectivity of an optically readable feature may also be used, in lieu of or in addition to using transmissivity, to provide such information. For example, in FIG. 15, a reflective member 187 projects from bottom 182 of nameplate 180. Reflective member 187 can be constructed using different combinations of materials to modify reflectivity and to exhibit substantial reflectivity to light in the ultraviolet, visible, or infrared regions of the electromagnetic spectrum. Reflective member 187 is readable by an optical sensor 195 disposed within housing 170 of image forming device 100. Optical sensor 195 includes an emitter 196 which emits optical energy to reflective member 187, and a corresponding detector 197 that receives an amount of the optical energy reflected by reflective member 187. Output signal corresponding to the optical energy received by detector 197 may then used by controller 102 to determine reflectivity of the reflective member 187 and, thereafter, determine one or more configuration settings to be used for customizing image forming device 100 based on the determined reflectively. Controller 102 may access one or more stored lookup tables in performing the determinations, with each stored lookup table including reflectivity values or other parameters derived from the output of optical sensor 190, and corresponding predetermined settings, in a similar manner as described above with respect to using transmissive member 186. It will also be appreciated that the example structures or arrangements of transmissive member(s) and sensor(s) described above with respect to using transmissive members can be applied when using reflective members.

With the above example embodiments, image forming device 100 can be customized with relatively less steps and time required by utilizing optically readable features on nameplates, which can allow for supply chain cost reductions. Further, although the description of the details of the example embodiments have been described using nameplates, it will be appreciated that the teachings and concepts provided herein are applicable to any replaceable member of image forming device 100 which are replaceable when performing customizations. Additionally, although the example embodiments discuss the customization of an image forming device, it will be appreciated that the configuration settings of an electronic device other than an image forming device (e.g., a desktop, laptop or tablet computer, a smartphone, a video game console, the controller of an automobile or a manufacturing machine, etc.) may be updated or customized using an optical sensor and a corresponding optical member as discussed herein.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A system for customizing settings of an electronic device, the system comprising:

a replaceable component having an optical member for receiving optical energy, the optical member having an optical characteristic that reduces an amount of the optical energy that leaves the optical member to a fraction of an amount of the optical energy received by the optical member;

a support located on an outer casing of the electronic device, the replaceable component removably mountable on the support, the optical member positioned immobile relative to the support when the replaceable component is mounted on the support;

an optical sensor including a detector positioned to receive the amount of the optical energy leaving the optical member when the replaceable component is mounted on the support; and a controller coupled to the optical sensor and operative to determine one or more predetermined settings to be applied to the electronic device based at least upon the fraction of the optical energy received by the detector relative to the amount of the optical energy received by the optical member, wherein the optical member includes a transmissive member composed of a transmissive material that allows a fraction of the optical energy received by the optical member to pass through the transmissive material, the fraction of the optical energy passing through the transmissive material indicating the one or more predetermined settings.

2. The system of claim 1, wherein the optical sensor includes an emitter positioned to emit optical energy towards the optical member.

3. The system of claim 1, wherein the replaceable component includes a nameplate of the electronic device.

4. The system of claim 1, further comprising memory having stored therein a plurality of possible configuration settings for the electronic device, wherein the controller determines the one or more predetermined settings from the plurality of possible configuration settings stored in the memory.

5. The system of claim 1, wherein the replaceable component includes a frame having an aperture, the optical member being insertable into the aperture.

6. The system of claim 1, wherein the support includes a slot through which the optical member is inserted when the replaceable component is mounted on the support, the optical sensor being positioned adjacent to the slot to detect the optical characteristic of the optical member.

7. The system of claim 1, wherein the optical member is formed as a unitary piece with the replaceable component.

8. The system of claim 1, wherein the optical member is detachably attached to the replaceable component.

9. A system for configuring one or more settings of an imaging device, the system comprising:

a portion of an outer casing of the imaging device mountable on a support of the imaging device;

an optical member on the portion of the outer casing having an optical characteristic that is indicative of configuration settings to be used by the imaging device among a plurality of possible configurations settings for the imaging device;

an optical sensor positioned to detect the optical characteristic of the optical member when the portion of the outer casing of the imaging device is mounted on the support; and a controller communicatively coupled to the optical sensor and operative to adjust one or more configuration settings of the imaging device based upon the detected optical characteristic of the optical member.

10. The system of claim 9, wherein the optical member is formed as a unitary piece with the portion of the outer casing.

11. The system of claim 9, wherein the portion of the outer casing includes a frame, the optical member being provided as an insert to the frame.

12. The system of claim 9, wherein the portion of the outer casing includes a slot through which the optical member is inserted when the portion of the outer casing is mounted on the support, the optical sensor being positioned adjacent to the slot such that the optical member moves into an optical path of the optical sensor when the portion of the outer casing is mounted on the support.

13. The system of claim 9, further comprising memory having stored therein a plurality of transmissivity values associated with the plurality of possible configuration settings for the imaging device, wherein the optical characteristic includes a transmissivity of the optical member and the controller adjusts the one or more configuration settings by applying at least one of the plurality of possible configuration settings associated with the transmissivity of the optical member.

14. The system of claim 9, wherein the optical member is detachable from the portion of the outer casing of the imaging device.

15. An image forming device, comprising:

a replaceable component having a transmissive region composed of a transmissive material that allows a fraction of optical energy received by the transmissive region to pass through the transmissive material modifying an amount of optical energy that leaves the transmissive region relative to an amount of optical energy received by the transmissive region;

an optical sensor positioned to detect the amount of optical energy that leaves the transmissive region when the replaceable component is installed on the image forming device;

memory having stored therein a plurality of transmissivity values associated with a plurality of possible configuration settings for the image forming device; and a controller communicatively coupled to the optical sensor and the memory, the controller operative to compare the detected amount of optical energy that leaves the transmissive region relative to the amount of optical energy received by the transmissive region to the stored plurality of transmissivity values to determine configuration settings corresponding to the detected amount of optical energy that leaves the transmissive region relative to the amount of optical energy received by the transmissive region, and to configure the image forming device based upon the determined configuration settings.

16. The image forming device of claim 15, wherein the replaceable component forms part of an outer casing of the image forming device.

17. The image forming device of claim 15, wherein the replaceable component includes a nameplate of the image forming device.

18. The image forming device of claim 15, further comprising a housing having a support on which the replaceable component is mountable, the support having a slot through which the transmissive region is insertable and the optical sensor being positioned adjacent to the slot such that transmissive region moves into an optical path of the optical sensor when the replaceable component is mounted on the support.

19. The image forming device of claim 18, further comprising a second replaceable component attachable to the housing, the second replaceable component having a second transmissive region that is composed of a second transmissive material that allows a fraction of optical energy received by the second transmissive region to pass through the second transmissive material and that is positioned in the optical path of the optical sensor when the second replaceable component is attached to the housing, wherein the controller determines configuration settings corresponding to a detected amount of optical energy that leaves the second transmissive region relative to the amount of optical energy received by the second transmissive region.

20. The image forming device of claim 15, wherein the transmissive region is detachably attached to the replaceable component.

21. A system for configuring one or more settings of an electronic device, the system comprising:

a portion of an outer casing of the electronic device mountable on a support of the electronic device;

an optical member on the portion of the outer casing having an optical characteristic that is indicative of configuration settings to be used by the electronic device among a plurality of possible configurations settings for the electronic device;

an optical sensor positioned to detect the optical characteristic of the optical member when the portion of the outer casing of the electronic device is mounted on the support; and a controller communicatively coupled to the optical sensor and operative to adjust one or more configuration settings of the electronic device based upon the detected optical characteristic of the optical member.

22. An electronic device, comprising:

a replaceable component having a transmissive region composed of a transmissive material that allows a fraction of optical energy received by the transmissive region to pass through the transmissive material modifying an amount of optical energy that leaves the transmissive region relative to an amount of optical energy received by the transmissive region;

an optical sensor positioned to detect the amount of optical energy that leaves the transmissive region when the replaceable component is installed on the electronic device;

memory having stored therein a plurality of transmissivity values associated with a plurality of possible configuration settings for the electronic device; and a controller communicatively coupled to the optical sensor and the memory, the controller operative to compare the detected amount of optical energy that leaves the transmissive region relative to the amount of optical energy received by the transmissive region to the stored plurality of transmissivity values to determine configuration settings corresponding to the detected amount of optical energy that leaves the transmissive region relative to the amount of optical energy received by the transmissive region, and to configure the electronic device based upon the determined configuration settings.

* * * * *